US010978031B2

(12) United States Patent
Hasebe

(10) Patent No.: US 10,978,031 B2
(45) Date of Patent: Apr. 13, 2021

(54) SOUND SIGNAL GENERATION DEVICE, SOUND SIGNAL GENERATION METHOD AND NON-TRANSITORY COMPUTER READABLE MEDIUM STORING SOUND SIGNAL GENERATION PROGRAM

(71) Applicant: YAMAHA CORPORATION, Hamamatsu (JP)

(72) Inventor: Masahiko Hasebe, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/590,721

(22) Filed: Oct. 2, 2019

(65) Prior Publication Data

US 2020/0111462 A1 Apr. 9, 2020

(30) Foreign Application Priority Data

Oct. 5, 2018 (JP) ..... JP2018-190404

(51) Int. Cl.
*G10H 1/34* (2006.01)
*G10H 1/14* (2006.01)
*G10H 1/00* (2006.01)

(52) U.S. Cl.
CPC ..... *G10H 1/14* (2013.01); *G10H 1/0008* (2013.01); *G10H 1/344* (2013.01); *G10H 2220/221* (2013.01)

(58) Field of Classification Search
CPC ..... G10F 5/00; G10H 1/344; G10H 1/346; G10H 1/34; G10H 2220/221; G10H 2220/265; G10H 2250/035; G10C 3/12; G10C 5/10; G10D 13/09
See application file for complete search history.

(56) References Cited

U.S. PATENT DOCUMENTS 5,619,005 A * 4/1997 Shibukawa ..... G10H 1/053 84/658
6,111,174 A * 8/2000 Oba ..... G10F 1/02 84/13
6,229,081 B1 * 5/2001 Ura ..... G10H 1/344 84/19
6,359,207 B1 * 3/2002 Oba ..... G10G 3/04 84/20

(Continued)

FOREIGN PATENT DOCUMENTS

JP H07121169 A 5/1995
JP H10161658 A 6/1998

(Continued)

*Primary Examiner* — Marlon T Fletcher
(74) *Attorney, Agent, or Firm* — Rossi, Kimms & McDowell LLP

(57) ABSTRACT

A sound signal generation device comprises a first signal generation instructor and a second signal generation instructor. The first signal generation instructor provides an instruction for generating a key depression sound signal corresponding to a key depression at the time of the key depression based on key operation information corresponding to an operation of each key of a keyboard. The second signal generation instructor provides an instruction for generating a key release sound signal according to a manner of a key release at the time of the key release based on the key operation information.

18 Claims, 8 Drawing Sheets

(56) References Cited

U.S. PATENT DOCUMENTS

| | | | | |
|---|---|---|---|---|
| 2001/0003945 | A1* | 6/2001 | Muramatsu | G10F 1/02 84/658 |
| 2001/0027714 | A1 | 10/2001 | Kondo | |
| 2007/0131099 | A1* | 6/2007 | Nishida | G10H 1/46 84/658 |
| 2010/0107857 | A1* | 5/2010 | Hasebe | G10H 1/057 84/615 |
| 2015/0170624 | A1* | 6/2015 | Yamauchi | G10H 1/0008 84/600 |
| 2016/0055839 | A1* | 2/2016 | Ilimura | G10H 1/24 84/659 |
| 2017/0345404 | A1 | 11/2017 | Kushimiya | |
| 2020/0111462 | A1* | 4/2020 | Hasebe | G10H 1/14 |

FOREIGN PATENT DOCUMENTS

| | | | |
|---|---|---|---|
| JP | 2001236064 | A | 8/2001 |
| JP | 3633420 | B2 | 3/2005 |
| JP | 3642130 | B2 | 4/2005 |
| JP | 2016038543 | A | 3/2016 |
| JP | 2017215382 | A | 12/2017 |

* cited by examiner

SOUND SIGNAL GENERATION DEVICE, SOUND SIGNAL GENERATION METHOD AND NON-TRANSITORY COMPUTER READABLE MEDIUM STORING SOUND SIGNAL GENERATION PROGRAM

BACKGROUND OF THE INVENTION

Field of the Invention

The present invention relates to a sound signal generation device, a sound signal generation method and a non-transitory computer readable medium storing a sound signal generation program.

Description of Related Art

In a piano, which is a natural musical instrument, dampers are respectively provided at strings corresponding to a plurality of keys. The damper corresponding to each key is in contact with a string at the time of a key release. The damper is released from the string at the time of a key depression, so that the string can vibrate. A musical sound generation device for reproducing a musical sound generated in a piano using an electronic musical instrument has been known. In a musical sound generation device described in JP 3633420 B2, a key-off sound is generated when a key release operation is performed. The key-off sound is a distorted sound component that is generated when a damper returns to a string position corresponding to the key by a key release.

BRIEF SUMMARY OF THE INVENTION

In the musical sound generation device described in the above-mentioned JP 3633420 B2, the key-off sound is generated after a user performs the key release operation. Thus, the sound resembling a piano sound at the time of a key release is reproduced. However, it is desired that differences in behavior of sound generation due to differences in musical performance style of a user are expressed.

The present invention is to provide a sound signal generation device, a sound signal generation method and a non-transitory computer readable medium storing a sound signal generation program that can express a difference in behavior of sound generation due to a difference in musical performance style of a user.

A sound signal generation device according to one aspect of the present invention includes a first signal generation instructor configured to provide an instruction for generating a key depression sound signal corresponding to a key depression based on key operation information corresponding to an operation of one or more keys of a keyboard, and a second signal generation instructor configured to provide an instruction for generating a key release sound signal according to a manner of a key release based on the key operation information.

The sound signal generation may further include a determiner configured to determine whether a key is in a first key position corresponding to a key depression state or a second key position corresponding to a key release state in a course of the key moving from the key depression state to the key release state based on the key operation information, wherein the manner of the key release may include a moving speed of the key in a predetermined period of time that starts at a point in time between a first point in time at which the key is in the first key position and a second point in time at which the key is in the second key position.

The second signal generation instructor may be configured to provide the instruction for generating the key release sound signal at different points in time according to the moving speed of the key in the predetermined period of time.

The determiner may be further configured to determine whether the key is in a third key position between the first key position and the second key position in the course of the key moving from the key depression state to the key release state, the predetermined period of time may be a period of time not occurring earlier than a third point in time at which the key is in the third key position, and the second signal generation instructor may be configured to provide an instruction for generating a first key release sound signal as the key release sound signal at the second point in time or later than the second point in time in a case where the moving speed of the key in the predetermined period of time is equal to or higher than a threshold value, and may be configured to provide an instruction for generating a second key release sound signal as the key release sound signal before the second point in time in a case where the moving speed of the key in the predetermined period of time is lower than the threshold value.

The second signal generation instructor may be configured to provide an instruction for generating a first key release sound signal as the key release sound signal at the second point in time or later than the second point in time in a case where the key arrives at the second key position by a fourth point in time at which a predetermined time elapses from the first point in time, and may be configured to provide an instruction for generating a second key release sound signal as the key release sound signal before the second point in time in a case where the key does not arrive at the second key position by the fourth point in time.

The determiner may be configured to continuously determine a position of the key in the course of the key moving from the key depression state to the key release state, the predetermined period of time may be a period of time not occurring earlier than a third point in time at which the key is in a third key position between the first key position and the second key position, and the second signal generation instructor may be configured to provide an instruction for generating a first key release sound signal as the key release sound signal at the second point in time or later than the second point in time in a case where the moving speed of the key in the predetermined period of time is equal to or higher than a threshold value, and may be configured to provide an instruction for generating a second key release sound signal as the key release sound signal before the second point in time in a case where the moving speed of the key in the predetermined period of time is lower than the threshold value.

The first point in time may be a point in time at which a key is in a depression state in an acoustic piano, the second point in time may be a point in time at which the key is in a release state in the acoustic piano, and the third point in time may be a point in time at which a string corresponding to the key starts to come into contact with a damper in a course of moving of the key from the key depression state to the key release state in the acoustic piano.

The sound signal generation device may further include a change instructor configured to provide an instruction for changing an attenuation rate of a volume of the key depression sound signal to a first value at a point in time corresponding to a point in time at which a string starts to come into contact with a damper in a course of moving of a key from a depression state to a release state in an acoustic piano and for changing the attenuation rate of the volume of the key depression sound signal to a second value that is larger than the first value at the second point in time, based on the key operation information.

A sound signal generation method according to another aspect of the present invention includes providing an instruction for generating a key depression sound signal corresponding to a key depression based on key operation information corresponding to an operation of one or more keys of a keyboard, and providing an instruction for generating a key release sound signal according to a manner of a key release based on the key operation information.

The sound signal generation method may further include determining whether a key is in a first key position corresponding to a key depression state or a second key position corresponding to a key release state in a course of the key moving from the key depression state to the key release state based on the key operation information, wherein the manner of the key release may include a moving speed of the key in a predetermined period of time that starts at a point in time between a first point in time at which the key is in the first key position and a second point in time at which the key is in the second key position.

The providing the instruction for generating the key release sound signal may include providing an instruction for generating the key release sound signal at different points in time according to the moving speed of the key in the predetermined period of time.

The sound signal generation method may further include determining whether the key is in a third key position between the first key position and the second key position in the course of the key moving from the key depression state to the key release state, wherein the predetermined period of time may be a period of time not occurring earlier than a third point in time at which the key is in the third key position, wherein providing the instruction for generating the key release sound signal may include providing an instruction for generating a first key release sound signal as the key release sound signal at the second point in time or later than the second point in time in a case where the moving speed of the key in the predetermined period of time is equal to or higher than a threshold value, and providing an instruction for generating a second key release sound signal as the key release sound signal before the second point in time in a case where the moving speed of the key in the predetermined period of time is lower than the threshold value.

The providing the instruction for generating the key release sound signal may include providing an instruction for generating a first key release sound signal as the key release sound signal at the second point in time or later than the second point in time in a case where the key arrives at the second key position by a fourth point in time at which a predetermined time elapses from the first point in time, and providing an instruction for generating a second key release sound signal as the key release sound signal before the second point in time in a case where the key does not arrive at the second key position by the fourth point in time.

The sound signal generation method may further include continuously determining a position of the key in the course of the key moving from the key depression state to the key release state, wherein the predetermined period of time may be a period of time not occurring earlier than a third point in time at which the key is in a third key position between the first key position and the second key position, and wherein providing the instruction for generating the key release sound signal may include providing an instruction for generating a first key release sound signal as the key release sound signal at the second point in time or later than the second point in time in a case where the moving speed of the key in the predetermined period of time is equal to or higher than a threshold value, and providing an instruction for generating a second key release sound signal as the key release sound signal before the second point in time in a case where the moving speed of the key in the predetermined period of time is lower than the threshold value.

The first point in time may be a point in time at which a key is in a depression state in an acoustic piano, the second point in time is a point in time at which the key is in a release state in the acoustic piano, and the third point in time may be a point in time at which a string corresponding to the key starts to come into contact with a damper in a course of moving of the key from the key depression state to the key release state in the acoustic piano.

The sound signal generation method may further include providing an instruction for changing an attenuation rate of a volume of the key depression sound signal to a first value at a point in time corresponding to a point in time at which a string starts to come into contact with a damper in a course of moving of a key from a depression state to a release state in an acoustic piano and changing the attenuation rate of the volume of the key depression sound signal to a second value that is larger than the first value at the second point in time, based on the key operation information.

A non-transitory computer readable medium storing a sound signal generation program according to yet another aspect of the present invention, the sound signal generation program, when executed by a computer, causing the computer to provide an instruction for generating a key depression sound signal corresponding to a key depression based on key operation information corresponding to an operation of one or more keys of a keyboard, and provide an instruction for generating a key release sound signal according to a manner of a key release based on the key operation information.

Other features, elements, characteristics, and advantages of the present invention will become more apparent from the following description of preferred embodiments of the present invention with reference to the attached drawings.

DESCRIPTION OF THE PREFERRED EMBODIMENTS

A sound signal generation device, a sound signal generation method and a non-transitory computer readable medium storing a sound signal generation program according to embodiments of the present invention will be mentioned below in detail with reference to the drawings.

[1] First Embodiment (1) Configuration of Electronic Musical Apparatus

Figure 1:
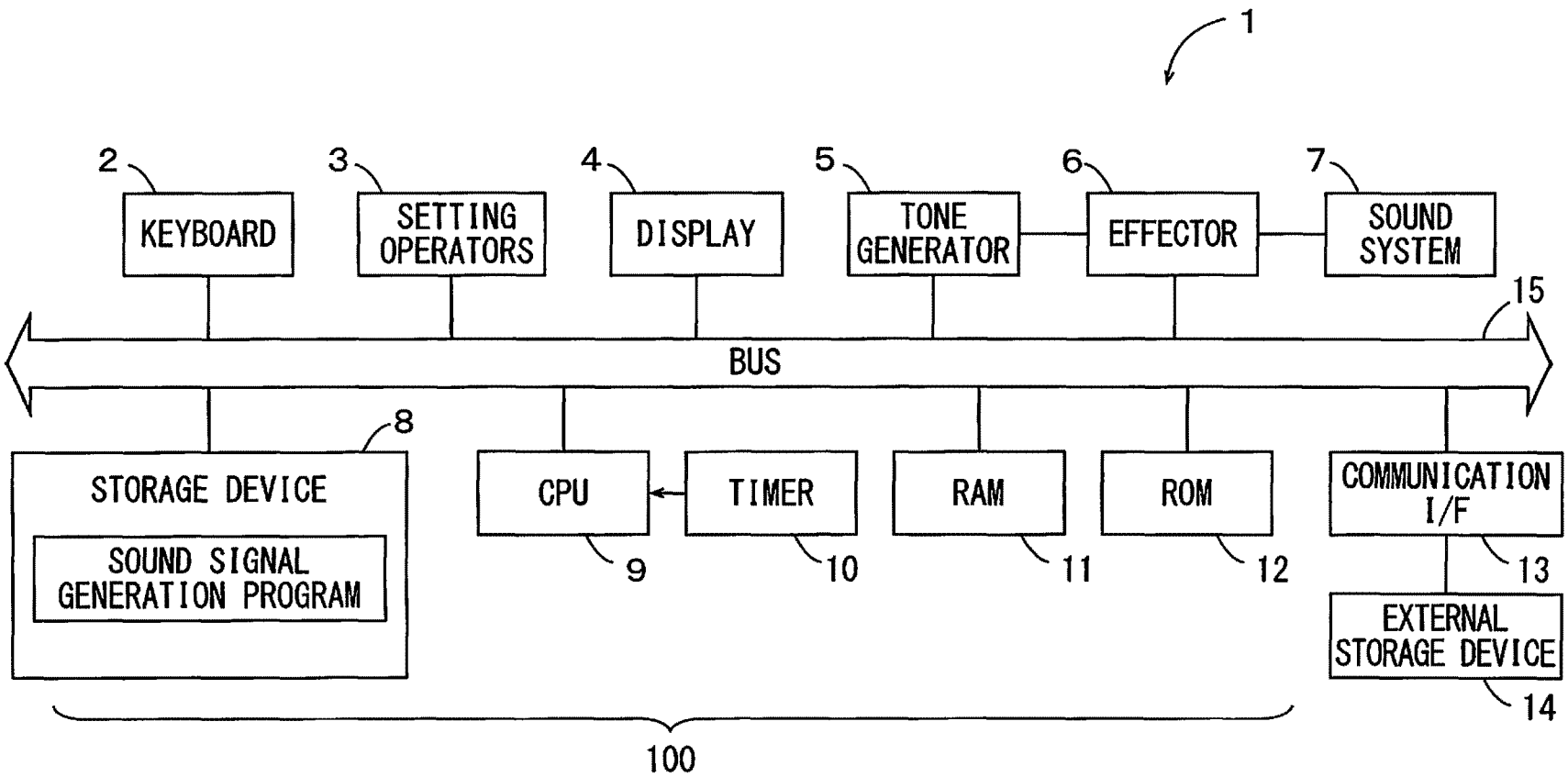
FIG. 1 is a block diagram showing the configuration of an electronic musical apparatus including a sound signal generation device according to a first embodiment of the present invention.

FIG. 1 is a block diagram showing the configuration of an electronic musical apparatus including the sound signal generation device according to the first embodiment of the present invention.

The electronic musical apparatus 1 of FIG. 1 is an electronic keyboard musical instrument, for example. The electronic musical apparatus 1 comprises a keyboard 2, setting operators 3 and a display 4. In the present embodiment, the keyboard 2 has a plurality of keys and is connected to a bus 15. The setting operators 3 include operation switches that are operated in an on-off manner, operation switches that are operated in a rotational manner or operation switches that are operated in a sliding manner, etc., and are connected to the bus 15. These setting operators 3 are used for adjustment of the volume, on-off of a power supply and various settings.

The display 4 includes a liquid crystal display, for example, and is connected to the bus 15. A music score or other various information is displayed on the display 4. The display 4 may be a touch panel display. In this case, part or all of the setting operators 3 may be displayed on the display 4. A user can provide instructions for various operations by operating the display 4.

The electronic musical apparatus 1 comprises a tone generator 5, an effector 6 and a sound system 7. The tone generator 5 is connected to the bus 15 and generates a key depression sound signal, a first key release sound signal and a second key release sound signal based on an operation of each key of the keyboard 2. The key depression sound signal, the first key release sound signal and the second key release sound signal are audio data (audio signals). The key depression sound signal, the first key release sound signal and the second key release sound signal will be described below in detail. The effector 6 gives various acoustic effects to the key depression sound signal, the first key release sound signal and the second key release sound signal that are generated by the tone generator 5. The sound system 7 includes a digital-analogue (D/A) conversion circuit, an amplifier and a speaker. The sound system 7 converts the key depression sound signal, the first key release sound signal and the second key release sound signal that are supplied through the effector 6 from the tone generator 5 into an analogue sound signal, and generates a sound based on the analogue sound signal.

The electronic musical apparatus 1 further includes a storage device 8, a CPU (Central Processing Unit) 9, a timer 10, a RAM (Random Access Memory) 11, a ROM (Read Only Memory) 12 and a communication I/F (Interface) 13. The storage device 8, the CPU 9, the RAM 11, the ROM 12 and the communication I/F 13 are connected to the bus 15. The timer 10 is connected to the CPU 9. An external device such as an external storage device 14 may be connected to the bus 15 via a communication I/F 13. The storage device 8 includes a storage media such as a hard disc, an optical disc, a magnetic disc or a memory card. A computer program such as the sound signal generation program is stored in the storage device 8.

The RAM 11 is a volatile memory, for example, which is used as a working area for the CPU 9, and temporarily stores various data. The ROM 12 is a nonvolatile memory, for example, and stores a control program. The ROM 12 may store a computer program such as the sound signal generation program. The CPU 9 executes the sound signal generation program stored in the storage device 8 or the ROM 12 to perform the sound signal generation method mentioned below. The timer 10 provides clock information indicating an elapse of time to the CPU 9. The storage device 8, the CPU 9, the timer 10, the RAM 11 and the ROM 12 constitute the sound signal generation device 100.

The sound signal generation program may be supplied in the form of being stored in a recording media which is readable by a computer, and installed in the storage device 8 or the ROM 12. Further, the sound signal generation program may be stored in the external storage device 14. In addition, in a case where the communication I/F 13 is connected to a communication network, the sound signal generation program delivered from a server connected to the communication network may be installed in the storage device 8 or the ROM 12.

(2) Configuration of Keyboard 2

Figure 2:
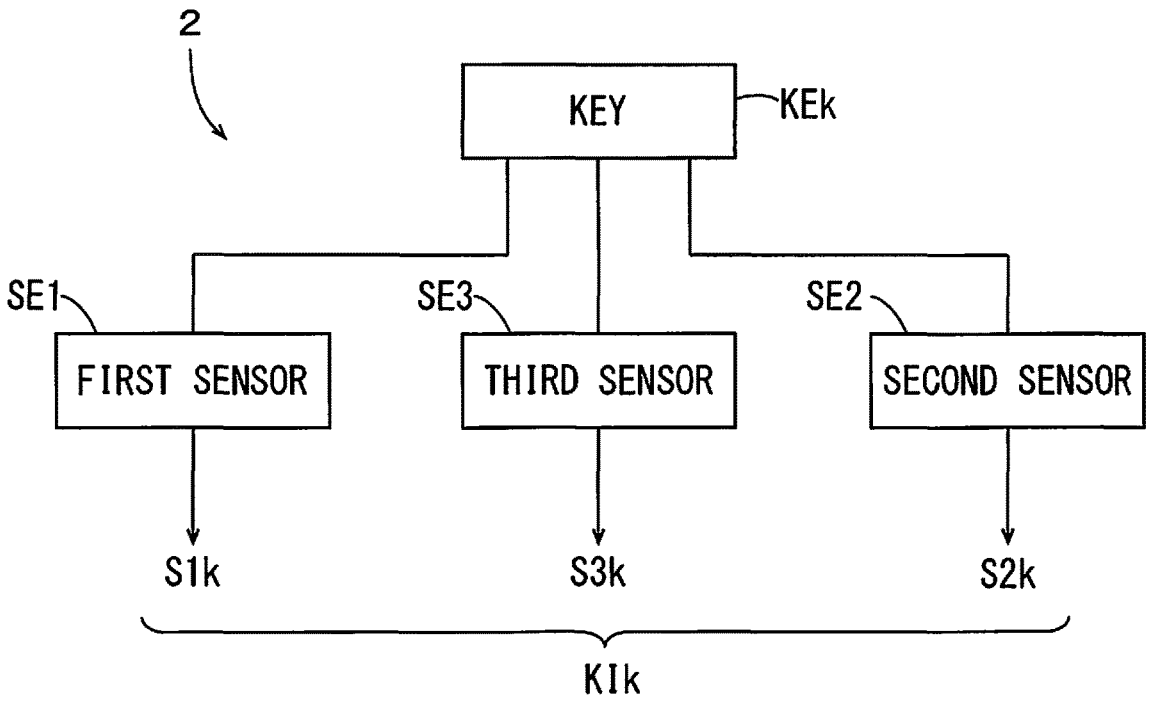
FIG. 2 is a schematic diagram showing the configuration of a keyboard of FIG. 1.

FIG. 2 is a schematic diagram showing the configuration of the keyboard 2 of FIG. 1. In the present embodiment, the keyboard 2 includes a plurality of keys KEk arranged in a row. FIG. 2 shows one key KEk. Here, "k" in the symbol "KEk" indicates the k-th key. In a case where the total number of keys is N, k is an integer of 1 to N.

First to third sensors SE1 to SE3 are provided in each key KEk. Each of the first to third sensors SE1 to SE3 is a photoelectric sensor or a mechanical switch, for example. The first sensor SE1 detects the key KEk being depressed (hereinafter referred to as a key depression state). The key depression state is equivalent to the state where the string corresponding to a key is released from a damper in an acoustic piano. That is, on the assumption that the electronic musical apparatus is the acoustic piano, the first sensor SE1 detects the key being depressed to a key depression position at which the key can make the damper be released from the string. The second sensor SE2 detects the key KEk not being depressed (hereinafter referred to as a key release state). The key release state is equivalent to the state where vibration of the string corresponding to the key is suppressed by the damper when a damper pedal is not depressed in the acoustic piano. On the assumption that the electronic musical apparatus is the acoustic piano, the second sensor SE2 detects the key having been returned to a key release position at which the key can make the damper be in contact with the string.

The third sensor SE3 detects a point in time at which the string corresponding to the key starts to be released from the damper in the course of moving from the key release state to the key depression state in the acoustic piano, and a point in time at which the string corresponding to the key starts to come into contact with the damper in the course of moving from the key depression state to the key release state in the acoustic piano. Hereinafter, the positions of the key at the point in time at which the string starts to be released from the damper and the point in time at which the string starts to come into contact with the damper are referred to as a damper release position.

When the key KEk is in the key depression position, the corresponding string can vibrate freely without coming into contact with the damper. When the key KEk is in the key release position, the corresponding string cannot vibrate freely. When the key KEk is in the damper release position, the corresponding string can vibrate while being in contact with the damper.

The key KEk moves to the key depression position from the key release position through the damper release position at the time of a key depression, and moves to the key release position from the key depression position through the damper release position at the time of a key release.

The first sensor SE1 outputs a key depression signal S1*k* indicating whether the key KEk is in the key depression position. When the key KEk is in the key depression position, the key depression signal S1*k* is in an ON state. When the key KEk is not in the key depression position, the key depression signal S1*k* is in an OFF state. The second sensor SE2 outputs a key release signal S2*k* indicating whether the key KEk is in the key release position. When the key KEk is in the key release position, the key release signal S2*k* is in an ON state. When the key KEk is not in the key release position, the key release signal S2*k* is in an OFF state. The third sensor SE3 outputs a damper release signal S3*k* indicating whether the key KEk is in the damper release position. When the key KEk is in the damper release position, the damper release signal S3*k* is in an ON state. When the key KEk is not in the damper release position, the damper release signal S3*k* is in an OFF state. The key depression signal S1*k*, the key release signal S2*k* and the damper release signal S3*k* corresponding to each key KEk are output as key operation information KIk.

(3) Configuration of Tone Generator 5

Figure 3:
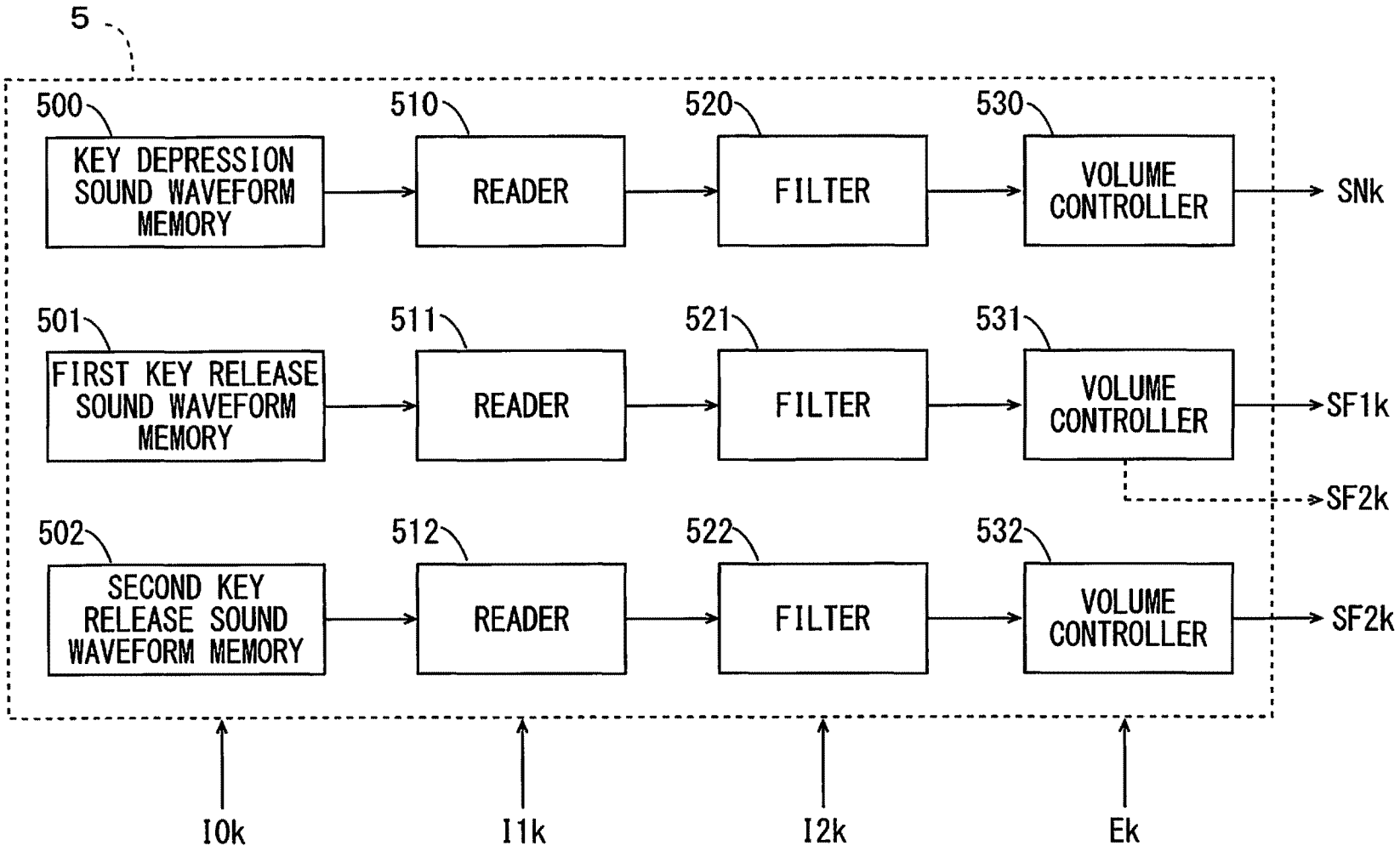
FIG. 3 is a block diagram showing the configuration of a tone generator.

FIG. 3 is a block diagram showing the configuration of the tone generator 5. As shown in FIG. 3, the tone generator 5 includes a key depression sound waveform memory 500, a first key release sound waveform memory 501, a second key release sound waveform memory 502, readers 510 to 512, filters 520 to 522 and volume controllers 530 to 532.

A plurality of key depression sound waveform data pieces respectively indicating the waveforms of a plurality of key depression sounds corresponding to the plurality of keys of the acoustic piano are stored in the key depression sound waveform memory 500. Each key depression sound waveform data piece is sampling data indicating the waveform of a sound, and is obtained by PCM (Pulse Code Modulation) recording of a sound that is generated when each key of the acoustic piano is depressed. For example, 88 key depression sound waveform data pieces corresponding to the 88 strings are stored. The reader 510 reads out the key depression sound waveform data piece having the pitch corresponding to the key depression signal S1*k* from the key depression sound waveform memory 500. The filter 520 performs filter processing for giving the change of a tone color to the key depression sound waveform data piece read by the reader 510. The volume controller 530 controls the temporal change of the envelope of the key depression sound waveform data piece, and outputs the controlled key depression sound waveform data piece as a key depression sound signal SNk.

In the first key release sound waveform memory 501, a plurality of first key release sound waveform data pieces indicating the waveforms of a plurality of first key release sounds are stored for each key or each set of a plurality of keys. A first key release sound is a distorted sound component that is generated when a damper returns to a string position corresponding to the key by a key release in the acoustic piano, and is also referred to as a key-off sound. The first key release sound waveform data pieces can be created by the next method, for example. The sampling waveform of a release portion of a key depression sound at the time of a key release is obtained as a first sampling waveform. Further, a second sampling waveform is obtained by attenuating, at the same attenuation rate as that of a key release sound at the time of a key release, the release portion of the key depression sound that attenuates with the key being in the key depression state. The first key release sound waveform data piece is obtained by calculating the difference between the first sampling waveform and the second sampling waveform. The reader 511 reads out the first key release sound waveform data piece corresponding to the key release signal S2*k* from the first key release sound waveform memory 501. The filter 521 performs filter processing for giving the change of a tone color to the first key release sound waveform data piece read by the reader 511. The volume controller 531 controls the temporal change of the envelope of the first key release sound waveform data piece, and outputs the controlled first key release sound waveform data piece as a first key release sound signal SF1*k*.

In the second key release sound waveform memory 502, a plurality of second key release sound waveform data pieces indicating the waveforms of a plurality of second key release sounds are stored for each key or each set of a plurality of keys. A second key release sound is a distorted sound component that is generated when the key is moved at a slow speed from the key depression position to the key release position in the acoustic piano. The second key release sound sounds "mya." The second key release sound is named as a damper leaking sound. The second key release sound waveform data piece may be obtained by modification of the first key release sound waveform data piece. Further, the second key release sound waveform data piece may be obtained by combination of a plurality of waveform data pieces. Further, the first key release sound waveform data piece may be used as the second key release sound waveform data piece without modification. The reader 512 reads out the second key release sound waveform data piece corresponding to the key release signal S2*k* from the second key release sound waveform memory 502. The filter 522 performs filter processing for giving the change of a tone color to the second key release sound waveform data piece read by the reader 512. The volume controller 532 controls the temporal change of the envelope of the second key release sound waveform data piece and outputs the controlled second key release sound waveform data piece as a second key release sound signal SF2*k*.

As indicated by the dotted arrow in FIG. 3, the second key release sound signal SF2*k* may be generated from the first key release sound waveform data piece. In this case, the second key release sound waveform memory 502, the reader 512, the filter 522 and the volume controller 532 do not have to be provided. In a case where the second key release sound signal SF2*k* is output, the cut-off frequency of the filter 521 is adjusted to the value for the second key release sound. Further, in the case where the second key release sound signal SF2*k* is output, the volume of the volume controller 531 is adjusted to the value for the second key release sound. Further, in the case where the second key release sound signal SF2*k* is output, the attack rate of the second key release sound signal SF2*k* may be adjusted by the volume controller 531.

Both of the first key release sound signal SF1*k* and the second key release sound signal SF2*k* may be generated from a key depression sound waveform data piece. In this case, the first key release sound waveform memory 501, the second key release sound waveform memory 502, the readers 511, 512 and the volume controllers 531, 532 do not have to be provided.

As explained below, when the key changes from the key depression state to the key release state, either one of the first key release sound signal SF1*k* and the second key release sound signal SF2*k* is selectively generated according to the key release speed.

(4) Generation of First and Second Key Release Sound Signals

Figure 4:
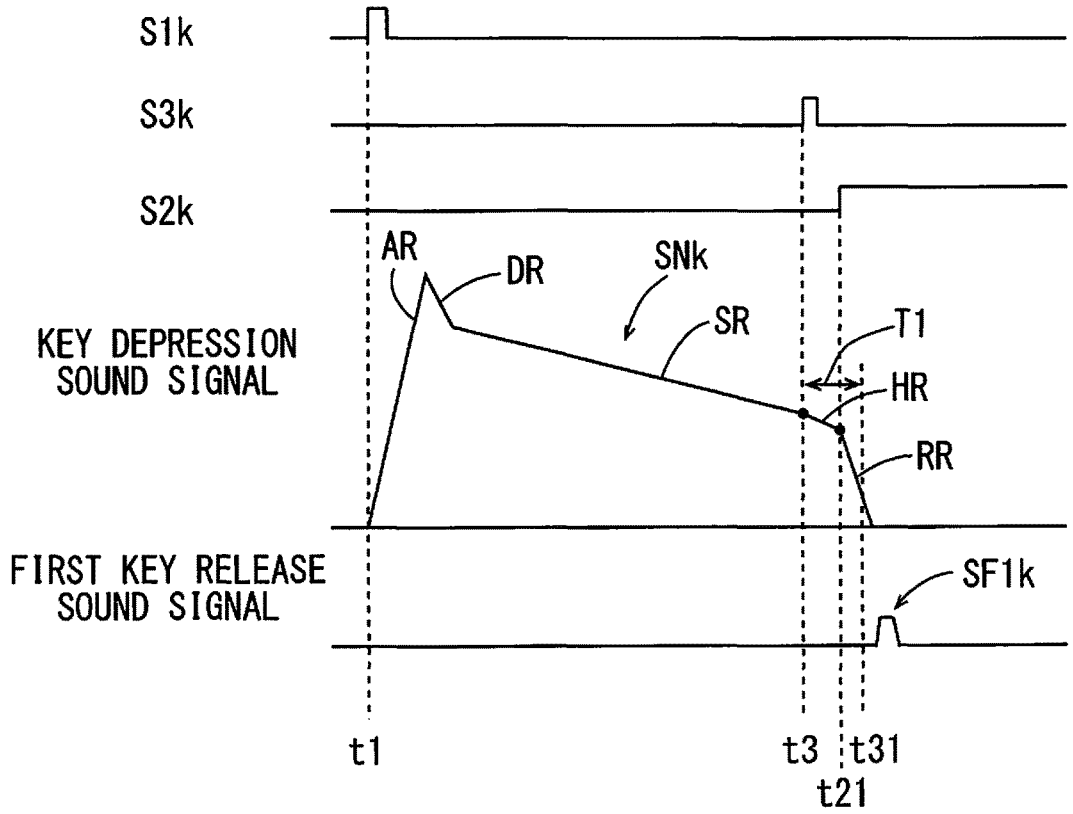
FIG. 4 is a waveform diagram for explaining generation of a first key release sound signal in the first embodiment.
Figure 5:
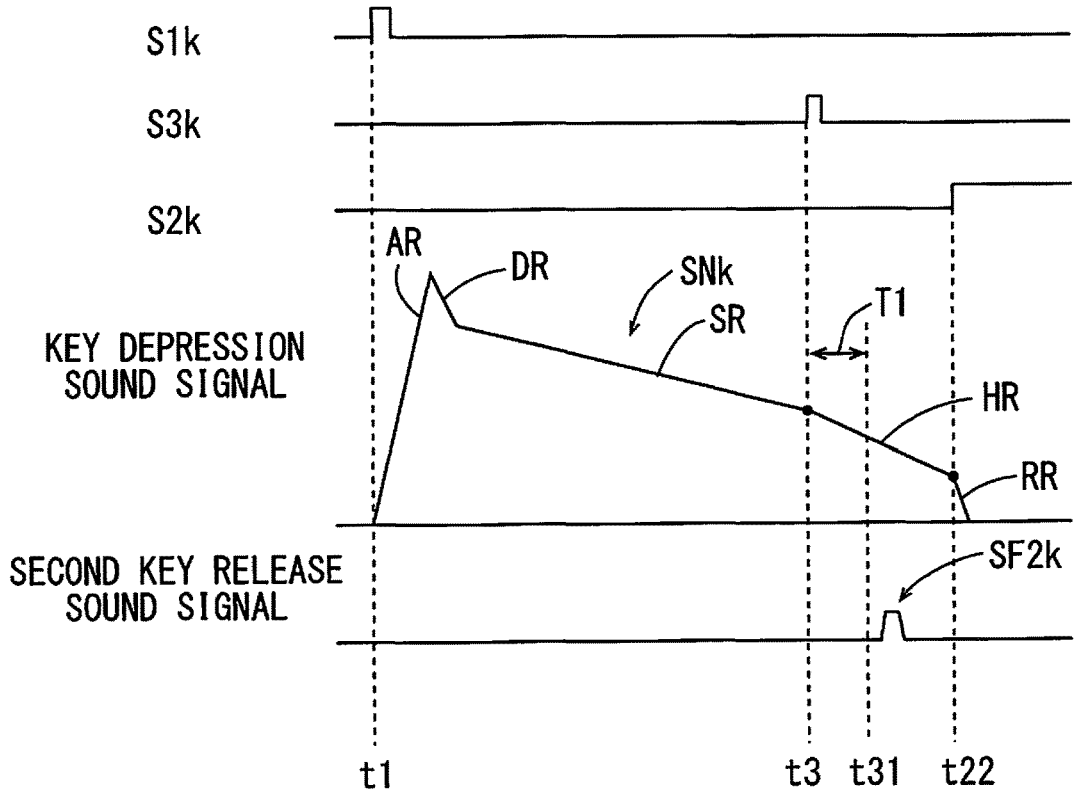
FIG. 5 is a waveform diagram for explaining generation of a second key release sound signal in the first embodiment.

FIG. 4 is a waveform diagram for explaining the generation of the first key release sound signal in the first embodiment. FIG. 5 is a waveform diagram for explaining the generation of the second key release sound signal in the first embodiment. In each of FIGS. 4 and 5, the key depression signal S1*k*, the damper release signal S3*k* and the key release signal S2*k* are shown in this order from the top. Further, in each of FIGS. 4 and 5, an envelope waveform of the key depression sound signal SNk is shown. The envelope waveform of the first key release sound signal SF1*k* is shown in FIG. 4, and the envelope waveform of the second key release sound signal SF2*k* is shown in FIG. 5. The abscissa of each waveform in FIGS. 4 and 5 indicates time. In each of FIGS. 4 and 5, a high level and a low level of each of the key depression signal S1*k*, the damper release signal S3*k* and the key release signal S2*k* correspond to an ON state and an OFF state, respectively. The ordinates of the key depression sound signal SNk, the first key release sound signal SF1*k* and the second key release sound signal SF2*k* indicate the volume.

As shown in FIGS. 4 and 5, when the key depression signal S1*k* is turned on at a point in time t1 by a user's key depression operation, the key depression sound signal SNk is generated. The volume of the key depression sound signal SNk is increased at an attack rate AR, attenuated at a decay rate DR and then attenuated at a sustain rate SR. The key KEk moves from the key depression position to the key release position by a user's key release operation. In this case, the damper release signal S3*k* is turned on at a point in time t3 at which the key KEk arrives at the damper release position. At the point in time t3, the attenuation rate of the volume of the key depression sound signal SNk is changed to a half rate HR. The half rate HR is larger than the sustain rate SR.

In the example of FIG. 4, the key KEk returns to the key release position at a point in time t21 before a predetermined speed determination period of time T1 elapses from the point in time t3, so that the key release signal S2*k* is turned on. In this case, the key KEk is returned to the key release position at a point in time t31, which is the end of the speed determination period of time T1. The attenuation rate of the volume of the key depression sound signal SNk is changed to the release rate RR at the point in time t21. The release rate RR is larger than the half rate HR. Further, the first key release sound signal SF1*k* is generated later than the point in time t21.

In the example of FIG. 5, the key KEk returns to the key release position at a point in time t22 after the speed determination period of time T1 is elapsed from the point in time t3, so that the key release signal S2*k* is turned on. In this case, the key KEk has not returned to the key release position by the point in time t31, which is the end of the speed determination period of time T1. The attenuation rate of the volume of the key depression sound signal SNk is changed to the release rate RR at the point in time t22. Further, the second key release sound signal SF2*k* is generated later than the point in time t31, which is the end of the speed determination period of time T1, and earlier than the point in time t22.

In the present embodiment, whether the moving speed of the key KEk at the time of a key release is lower than a predetermined threshold value is determined based on whether the key KEk has returned to the key release position by the point in time t31, which is the end of the speed determination period of time T1. In a case where the moving speed of the key KEk is equal to or higher than the threshold value, the first key release sound signal SF1*k* is generated after the key KEk returns to the key release position. In a case where the moving speed of the key KEk is lower than the threshold value, the second key release sound signal SF2*k* is generated after the key KEk passes through the damper release position and before the key KEk returns to the key release position.

(5) Functional Configuration of Sound Signal Generation Device 100

Figure 6:
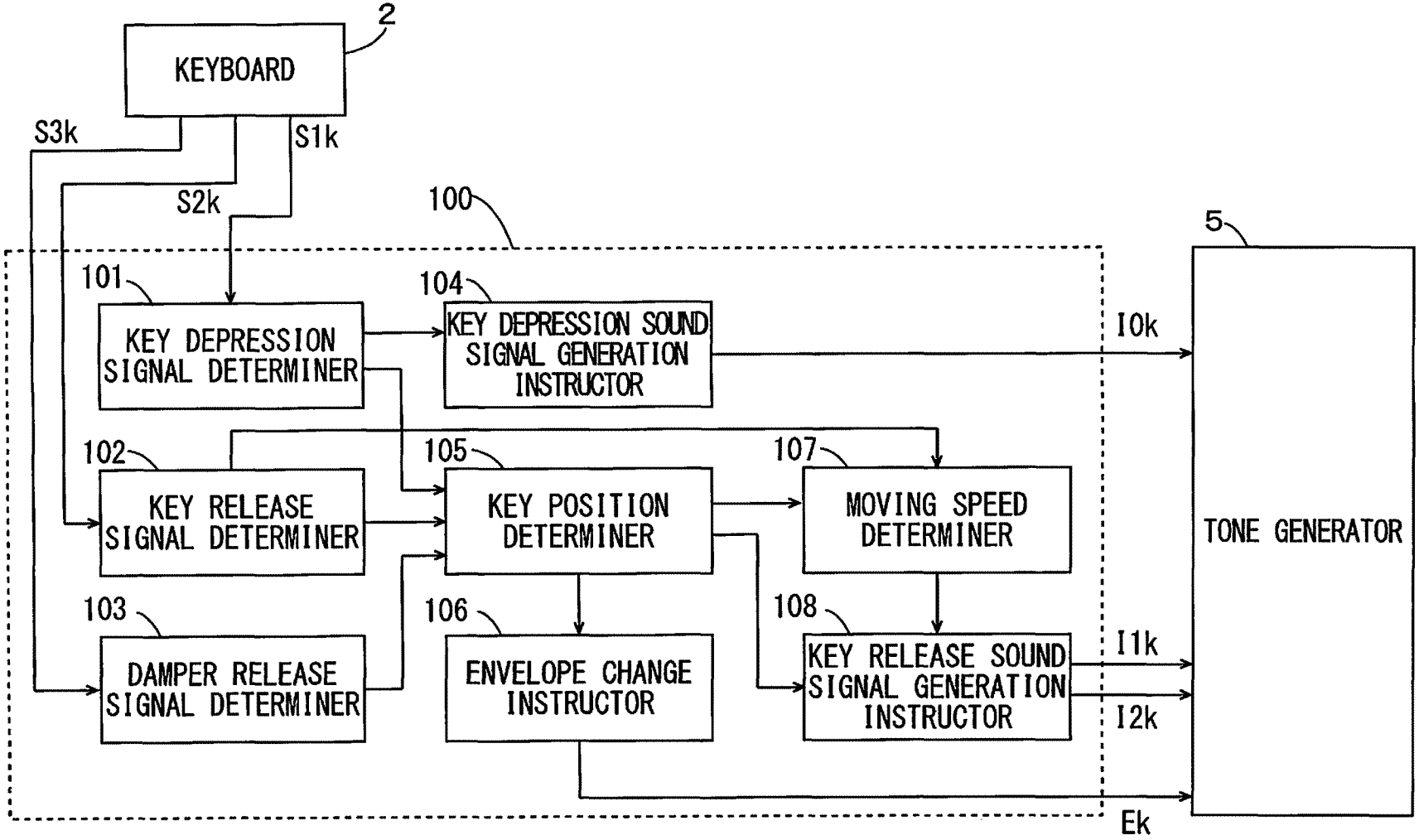
FIG. 6 is a block diagram mainly showing the functional configuration of the sound signal generation device of FIG. 1.

FIG. 6 is a block diagram mainly showing the functional configuration of the sound signal generation device 100 of FIG. 1. As shown in FIG. 6, the sound signal generation device 100 includes a key depression signal determiner 101, a key release signal determiner 102, a damper release signal determiner 103, a key depression sound signal generation instructor 104, a key position determiner 105, an envelope change instructor 106, a moving speed determiner 107 and a key release sound signal generation instructor 108. The CPU 9 of FIG. 1 executes the sound signal generation program stored in the storage device 8 or the ROM 12, whereby the function of each constituent (101 to 108) of the sound signal generation device 100 is realized. Part or all of the plurality of constituents (101 to 108) of the sound signal generation device 100 may be constituted by hardware such as an electronic circuit.

The key depression signal determiner 101 determines whether the key depression signal S1*k* output from the keyboard 2 is in the ON state or the OFF state. The key release signal determiner 102 determines whether the key release signal S2*k* output from the keyboard 2 is in the ON state or the OFF state. The damper release signal determiner 103 determines whether the damper release signal S3*k* output from the keyboard 2 is in the ON state or the OFF state.

The key depression sound signal generation instructor 104 provides a key depression sound signal generation instruction 10*k* to the tone generator 5 based on the result of determination by the key depression signal determiner 101. The key position determiner 105 determines whether the key KEk is in the damper release position or the key release position based on the result of determination by the key depression signal determiner 101, the result of determination by the key release signal determiner 102 and the result of determination by the damper release signal determiner 103. The envelope change instructor 106 provides an envelope change instruction Ek for changing the attenuation rate of the volume of the key depression sound signal SNk to the tone generator 5 based on the result of determination by the key position determiner 105.

The moving speed determiner 107 determines whether the moving speed of the key KEk is lower than the threshold value based on the result of determination by the key release signal determiner 102 and the result of determination by the key position determiner 105. The key release sound signal generation instructor 108 selectively provides a first key release sound signal generation instruction Ilk for generating the first key release sound signal SF1*k* or a second key release sound signal generation instruction 12*k* for generating the second key release sound signal SF2*k* based on the result of determination by the key position determiner 105 and the result of determination by the moving speed determiner 107.

(6) Sound Signal Generation Method

Figure 7:
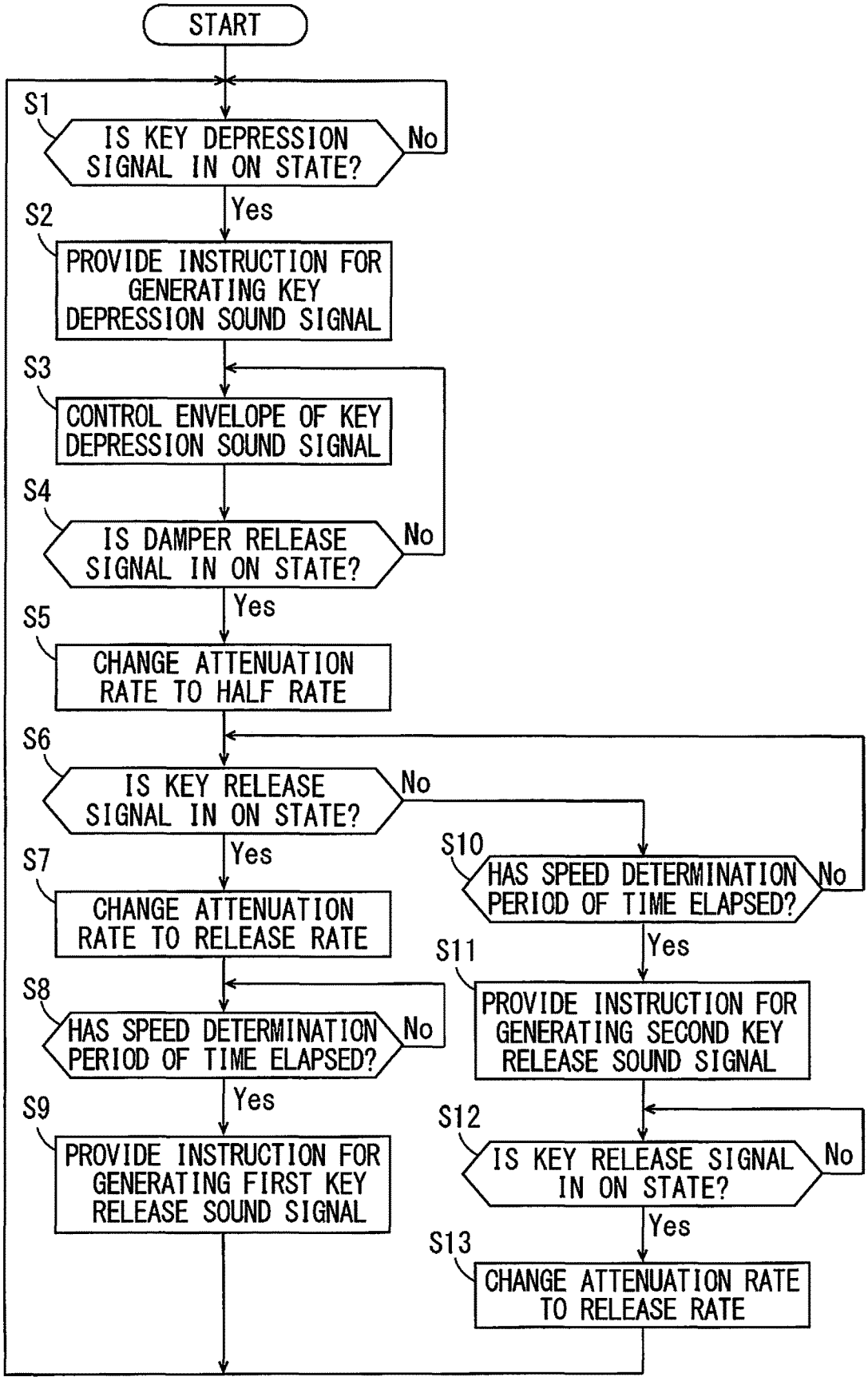
FIG. 7 is a flow chart showing a sound signal generation method in the first embodiment.

FIG. 7 is a flow chart showing the sound signal generation method in the first embodiment. The sound signal generation method of FIG. 7 is performed when the CPU 9 of FIG. 1 executes the sound signal generation program stored in the storage device 8 or the ROM 12.

First, the key depression signal determiner 101 determines whether the key depression signal S1*k* is in the ON state (step S1). In a case where the key depression signal S1*k* is not in the ON state, the key depression signal determiner 101 waits. When the key depression signal S1*k* is turned on, the key depression sound signal generation instructor 104 instructs the tone generator 5 to generate the key depression sound signal SNk (step S2). Thus, a key depression sound is generated from the sound system 7.

The envelope change instructor 106 controls the envelope of the key depression sound signal SNk (step S3). Specifically, as shown in FIGS. 4 and 5, the envelope change instructor 106 instructs the tone generator 5 to change the increase rate and the attenuation rate of the volume of the key depression sound signal SNk to the attack rate AR, the decay rate DR and the sustain rate SR in this order.

The damper release signal determiner 103 determines whether the damper release signal S3*k* is in the ON state (step S4). In a case where the damper release signal S3*k* is not in the ON state, the envelope change instructor 106 returns to the step S3, and continues controlling the envelope of the key depression sound signal SNk. When the damper release signal S3*k* is turned on, the envelope change instructor 106 instructs the tone generator 5 to change the attenuation rate of the volume of the key depression sound signal SNk to the half rate HR (step S5).

The key release signal determiner 102 determines whether the key release signal S2*k* is in the ON state (step S6). When the key release signal S2*k* is turned on, the envelope change instructor 106 instructs the tone generator 5 to change the attenuation rate of the volume of the key depression sound signal SNk to the release rate RR (step S7). The moving speed determiner 107 determines whether the speed determination period of time T1 has elapsed (step S8). In a case where the speed determination period of time T1 has not elapsed, the moving speed determiner 107 waits until the speed determination period of time T1 elapses.

In a case where the speed determination period of time T1 has elapsed, the key release sound signal generation instructor 108 instructs the tone generator 5 to generate the first key release sound signal SF1*k* (step S9). Thus, a first key release sound is generated from the sound system 7. After that, the key depression signal determiner 101 returns to the step S1.

In a case where the key release signal S2*k* is not in the ON state in the step S6, the moving speed determiner 107 determines whether the speed determination period of time T1 has elapsed (step S10). In a case where the speed determination period of time T1 has not elapsed, the key release signal determiner 102 returns to the step S6. When the speed determination period of time T1 has elapsed, the key release sound signal generation instructor 108 instructs the tone generator 5 to generate the second key release sound signal SF2*k* (step S11). Thus, a second key release sound is generated from the sound system 7.

The key release signal determiner 102 determines whether the key release signal S2*k* has been turned on (step S12). In a case where the key release signal S2*k* is not in the ON state, the key release signal determiner 102 waits until the key release signal S2*k* is turned on. When the key release signal S2*k* is turned on, the envelope change instructor 106 instructs the tone generator 5 to change the attenuation rate of the volume of the key depression sound signal SNk to the release rate RR (step S13). Thereafter, the key depression signal determiner 101 returns to the step S1.

[2] Second Embodiment

The configuration of an electronic musical apparatus 1 including a sound signal generation device 100 according to a second embodiment is similar to the configuration shown in FIG. 1 except for the following points. The functional configuration of the sound signal generation device 100 according to the second embodiment is similar to the configuration shown in FIG. 6 except for the following points.

In the electronic musical apparatus 1 according to the second embodiment, first and second sensors SE1, SE2 are provided in each key KEk of a keyboard 2 but a third sensor SE3 is not provided. Therefore, a key depression signal S1*k* and a key release signal S2*k* are output from the key KEk but a damper release signal S3*k* is not output. Further, in the sound signal generation device 100 according to the second embodiment, a damper release signal determiner 103 of FIG. 6 is not provided.

Figure 8:
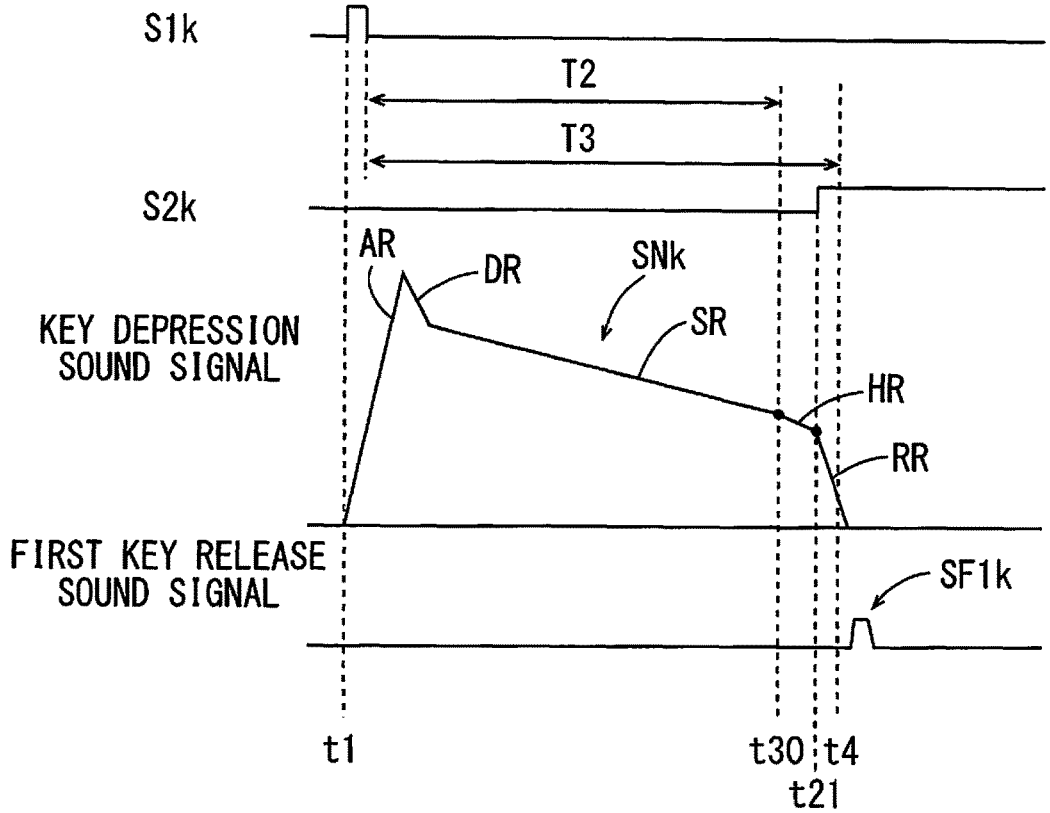
FIG. 8 is a waveform diagram for explaining generation of a first key release sound signal in a second embodiment.
Figure 9:
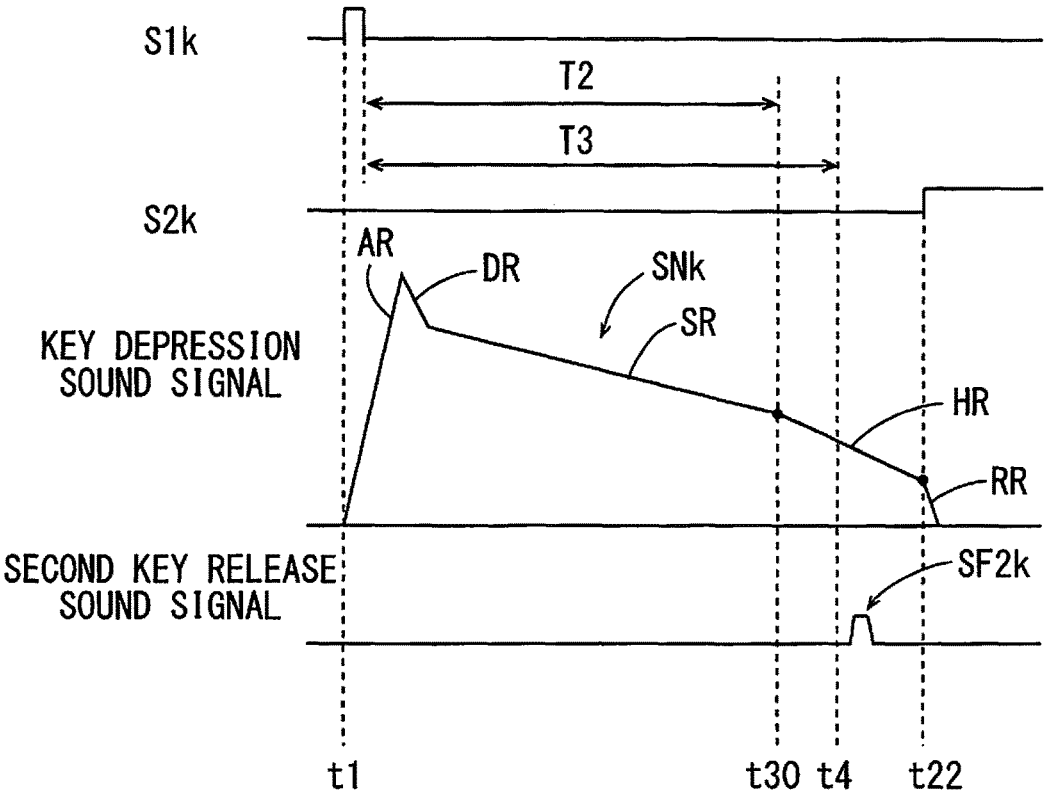
FIG. 9 is a waveform diagram for explaining generation of a second key release sound signal in the second embodiment.

FIG. 8 is a waveform diagram for explaining the generation of a first key release sound signal in the second embodiment. FIG. 9 is a waveform diagram for explaining the generation of a second key release sound signal in the second embodiment. The waveform diagrams of FIGS. 8 and 9 are different from the waveform diagrams of FIGS. 4 and 5 in the following points.

In FIGS. 8 and 9, a key depression signal S1*k* and a key release signal S2*k* are shown. In the present embodiment, a damper release signal S3*k* is not present. As shown in FIGS. 8 and 9, the attenuation rate of the volume of a key depression sound signal SNk is changed to the half rate HR at a point in time t30 at which a predetermined time (hereinafter referred to as a damper release position determination time T2) elapses from the point in time at which the key depression signal S1*k* is turned off. Here, the damper release position determination time T2 is preset such that the point in time t30 coincides with or is close to the point in time at which a string starts to come into contact with a damper in the course of moving from a key depression state to a key release state in an acoustic piano. That is, the point in time t30 corresponds to the point in time t3 at which the key KEk passes through the damper release position in the first embodiment.

In the second embodiment, it is determined whether the key KEk has returned to the key release position by a point in time t4 at which a predetermined time (hereinafter referred to as a key release determination time T3) elapses from the point in time at which the key depression signal S1*k* is turned off. The key release determination time T3 is longer than the damper release position determination time T2. The key release determination time T3 is used for determination of whether the moving speed of the key KEk from a key depression position to a key release position is lower than a threshold value.

In the example of FIG. 8, the key KEk returns to the key release position at a point in time t21 that is earlier than the point in time t4, so that the key release signal S2*k* is turned on. That is, the key KEk has returned to the key release position by the point in time t4. In this case, a first key release sound signal SF1*k* is generated at the point in time t21 or later than the point in time t21.

In the example of FIG. 9, the key KEk returns to the key release position at a point in time t22 that is later than the point in time t4, so that the key release signal S2*k* is turned on. That is, the key KEk has not returned to the key release position by the point in time t4. In this case, a second key release sound signal SF2*k* is generated later than a point in time t30 and earlier than the point in time t22.

Figure 10:
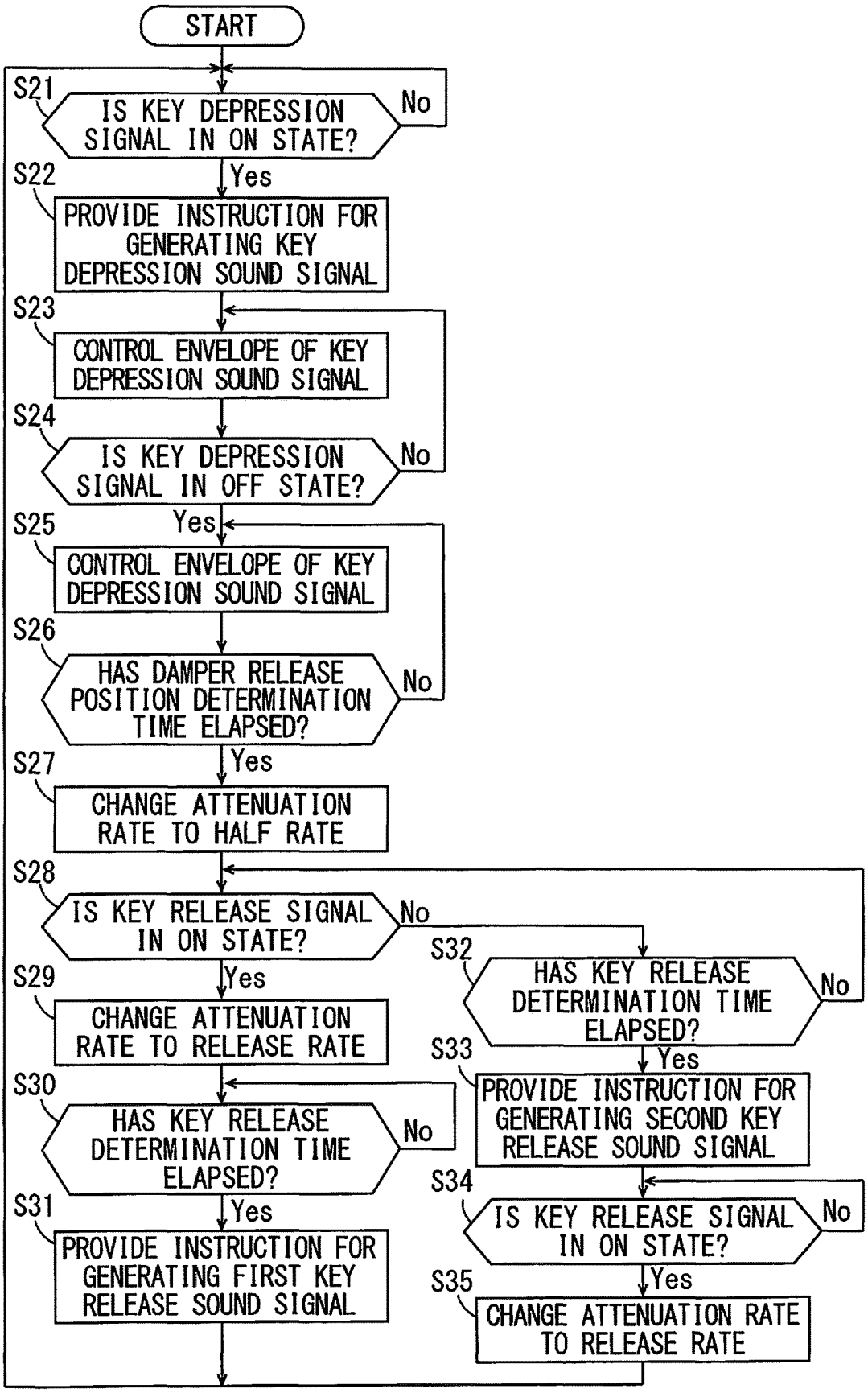
FIG. 10 is a flow chart showing a sound signal generation method in the second embodiment.

FIG. 10 is a flow chart showing a sound signal generation method in the second embodiment. First, a key depression signal determiner 101 determines whether the key depression signal S1*k* is in an ON state (step S21). In a case where the key depression signal S1*k* is not in the ON state, the key depression signal determiner 101 waits. When the key depression signal S1*k* is turned on, a key depression sound signal generation instructor 104 instructs a tone generator 5 to generate the key depression sound signal SNk (step S22). Thus, a key depression sound is generated from a sound system 7. An envelope change instructor 106 controls the envelope of the key depression sound signal SNk (step S23).

The key depression signal determiner 101 determines whether the key depression signal S1*k* has been turned off (step S24). In a case where the key depression signal S1*k* is not in an OFF state, the envelope change instructor 106 returns to the step S23 and continues controlling the envelope of the key depression sound signal SNk. When the key depression signal S1*k* is turned off, the envelope change instructor 106 controls the envelope of the key depression sound signal SNk (step S25). A key position determiner 105 determines whether the damper release position determination time T2 has elapsed (step S26). In a case where the damper release position determination time T2 has not elapsed, the envelope change instructor 106 returns to the step S25 and continues controlling the envelope of the key depression sound signal SNk.

When the damper release position determination time T2 has elapsed, the envelope change instructor 106 instructs the tone generator 5 to change the attenuation rate of the volume of the key depression sound signal SNk to a half rate HR (step S27). A key release signal determiner 102 determines whether the key release signal S2*k* is in the ON state (step S28). When the key release signal S2*k* is turned on, the envelope change instructor 106 instructs the tone generator 5 to change the attenuation rate of the volume of the key depression sound signal SNk to a release rate RR (step S29). A moving speed determiner 107 determines whether a key release determination time T3 has elapsed (step S30). In a case where the key release determination time T3 has not elapsed, the moving speed determiner 107 waits until the key release determination time T3 elapses.

When the key release determination time T3 has elapsed, a key release sound signal generation instructor 108 instructs the tone generator 5 to generate the first key release sound signal SF1*k* (step S31). Thus, a first key release sound is generated from the sound system 7. Thereafter, the key depression signal determiner 101 returns to the step S21.

In a case where the key release signal S2*k* is not in the ON state in the step S28, the moving speed determiner 107 determines whether the key release determination time T3 has elapsed (step S32). In a case where the key release determination time T3 has not elapsed, the key release signal determiner 102 returns to the step S28. When the key release determination time T3 has elapsed, the key release sound signal generation instructor 108 instructs the tone generator 5 to generate the second key release sound signal SF2*k* (step S33). Thus, a second key release sound is generated from the sound system 7.

The key release signal determiner 102 determines whether the key release signal S2*k* has been turned on (step S34). In a case where the key release signal S2*k* is not in the ON state, the key release signal determiner 102 waits until the key release signal S2*k* is turned on. When the key release signal S2*k* is turned on, the envelope change instructor 106 instructs the tone generator 5 to change the attenuation rate of the volume of the key depression sound signal SNk to the release rate RR (step S35). Thereafter, the key depression signal determiner 101 returns to the step S21.

[3] Third Embodiment

The configuration of an electronic musical apparatus 1 including a sound signal generation device 100 according to a third embodiment is similar to the configuration shown in FIG. 1 except for the following points. The functional configuration of the sound signal generation device 100 according to the third embodiment is similar to the configuration shown in FIG. 6 except for the following points. Further, a sound signal generation method in the third embodiment is similar to the method shown in FIGS. 4, 5 and 7 except for the differences of processing constituents.

In the electronic musical apparatus 1 according to the third embodiment, a position sensor that detects positions of the key KEk continuously (not in steps) is provided instead of the first to third sensors SE1 to SE3 in each key KEk of a keyboard 2. The position sensor outputs a detection signal indicating the position of the key KEk.

Further, in the sound signal generation device 100 according to the third embodiment, the key depression signal determiner 101, the key release signal determiner 102 and the damper release signal determiner 103 of FIG. 6 are not provided. A key position determiner 105 detects which one of a key depression position, a damper release position and a key release position the key KEk is in based on a detection signal output from the position sensor. When determining that the key KEk is in the key depression position based on the detection signal output from the position sensor, the key depression sound signal generation instructor 104 instructs the tone generator 5 to generate a key depression sound signal SNk. A moving speed determiner 107 determines the moving speed of the key KEk in a speed determination period of time T1 based on the detection signal output from the position sensor and a result of determination by the key position determiner 105. In this case, the speed determination period of time T1 is not limited to the period of time from the point in time t3 when the key KEk arrives at the damper release position but can be set to any period of time in which the key KEk moves from the key depression position to the key release position.

[4] Effects of Embodiments

In the first to third embodiments, the instruction for generating the key depression sound signal SNk corresponding to a key depression is provided based on the key operation information KIk corresponding to an operation of each key KEk of the keyboard 2 at the time of the key depression. Thus, the key depression sound having the pitch corresponding to the depressed key KEk is generated from the sound system 7. Further, at the time of a key release, the instruction for generating the first or second key release sound signal SF1*k*, SF2*k* according to the manner of the key release is provided based on the key operation information KIk. Thus, the first or second key release sound according to the manner of the key release is generated from the sound system 7. Therefore, differences in behavior of sound generation due to differences in musical performance style of the user can be expressed.

Further, in the first to third embodiments, the manner of the key release includes the moving speed of the key KEk in the predetermined period of time (the speed determination period of time T1, for example) that starts at a point in time between the point in time t1 at which the key KEk is in the key depression position and the point in time t21, t22 at which the key KEk is in the key release position. In this case, the instruction for generating the key release sound signal according to the moving speed of the key KEk in the predetermined period of time is provided. Thus, the key release sound according to the key release speed is generated.

Further, in the first to third embodiments, the instruction for generating the key release sound signals (first or second key release sound signal SF1*k*, SF2*k*, for example) at different points in time according to the moving speed of the key KEk in the speed determination period of time T1 is provided. Thus, the first or second key release sound is generated at different points in time from the sound system 7 according to the speed at which the user releases the key KEk.

In the first embodiment, it is determined whether the key KEk is in the damper release position between the key depression position and the key release position in the course of moving from the key depression state to the key release state. Further, the speed determination period of time T1 is set not earlier than the point in time t3 at which the key KEk is in the damper release position. In a case where the moving speed of the key KEk in the speed determination period of time T1 is equal to or higher than the threshold value, the instruction for generating the first key release sound signal SF1*k* at the point in time t21 or later than the point in time t21 at which the key KEk arrives at the key release position is provided. Thus, the first key release sound is generated from the sound system 7 after the key KEk arrives at the key release position. On the other hand, in a case where the moving speed of the key KEk in the speed determination period of time T1 is lower than the threshold value, the instruction for generating the second key release sound signal SF2*k* earlier than the point in time t22 at which the key KEk arrives at the key release position is provided. Thus, the second key depression sound is generated from the sound system 7 later than the point in time t3 at which the key KEk passes through the damper release position and before the key KEk arrives at the key release position. Therefore, the user can generate the first key release sound after the key KEk returns to the key release position by releasing the key at a normal speed, and can generate the second key release sound before the key KEk returns to the key release position by releasing the key slowly. Therefore, the user can express the difference in behavior of sound generation by changing the key release speed.

In the second embodiment, in a case where the key KEk has arrived at the key release position by the point in time t4 at which the key release determination time T3 elapses from the point in time t1 at which the key KEk is in the key depression position, the instruction for generating the first key release sound signal SF1*k* at the point in time t21 or later than the point in time t21 at which the key KEk arrives at the key release position is provided. Thus, in a case where the moving time of the key KEk from the key depression position to the key release position is short, the first key release sound is generated from the sound system 7 after the key KEk arrives at the key release position. In a case where the key KEk has not arrived at the key release position by the point in time t4 at which the key release determination time T3 elapses from the point in time t1 at which the key KEk is in the key depression position, the instruction for generating the second key release sound signal SF2*k* before the key KEk arrives at the key release position is provided. Thus, in a case where the moving time of the key KEk from the key depression position to the key release position is long, the second key release sound is generated from the sound system 7 before the key KEk arrives at the key release position. Therefore, the user can generate the first key release sound after the key KEk returns to the key release position by releasing the key at the normal speed, and can generate the second key release sound before the key KEk returns to the key release state by releasing the key slowly. Therefore, the user can express the difference in behavior of sound generation by changing the key release speed.

In the third embodiment, the positions of the key KEk changing from the key depression state to the key release state are continuously determined. In this case, whether the key KEk is in the damper release position between the key depression position and the key release position in the course of moving from the key depression state to the key release state is determined. Further, the speed determination period of time T1 is set not earlier than the point in time t3 at which the key KEk is in the damper release position. In a case where the moving speed of the key KEk in the speed determination period of time T1 is equal to or higher than the threshold value, the instruction for generating the first key release sound signal SF1*k* at the point in time t21 or later than the point in time t21 at which the key KEk arrives at the key release position is provided. Thus, the first key release sound is generated from the sound system 7 after the key KEk arrives at the key release position. On the other hand, in a case where the moving speed of the key KEk in the speed determination period of time T1 is lower than the threshold value, the instruction for generating the second key release sound signal SF2*k* earlier than the point in time t22 at which the key KEk arrives at the key release position is provided. Thus, the second key depression sound is generated from the sound system 7 later than the point in time t3 at which the key KEk passes through the damper release position and before the key KEk arrives at the key release position. Therefore, the user can generate the first key release sound after the key KEk returns to the key release position by releasing the key at the normal speed, and can generate the second key release sound before the key KEk returns to the key release position by releasing the key slowly. Thus, the user can express the difference in behavior of sound generation by changing the key release speed.

In the first to third embodiments, the point in time t1 is equivalent to a point in time at which a key is in a depression state in an acoustic piano, the points in time t21, t22 are equivalent to a point in time at which a key is in a release state in the acoustic piano, and the points in time t3, t30 are equivalent to a point in time at which the string corresponding to a key starts to come into contact with a damper in the course of moving of the key from the depression state to the release state in the acoustic piano. Therefore, behavior of sound generation close to the behavior of sound generation at the time of a key release in the acoustic piano can be reproduced.

In the first to third embodiments, the attenuation rate of the volume of the key depression sound signal SNk is changed to the half rate HR at the points in time t3, t30 corresponding to a point in time at which the string starts to come into contact with the damper in the course of moving from the key depression state to the key release state in the acoustic piano, and the attenuation rate of the volume of the key depression sound signal SNk is changed to the release rate RR that is larger than the half rate HR at the points in time t21, t22 at which the key KEk returns to the key release position. Thus, the key depression sound close to the key depression sound of the acoustic piano can be reproduced.

[5] Other Embodiments (1) While the first key release sound signal SF1*k* and the second key release sound signal SF2*k* are generated by the tone generator 5 in the above-mentioned embodiment, the present invention is not limited to this. The first key release sound signal SF1*k* and the second key release sound signal SF2*k* may be generated by the effector 6 based on the key depression sound signal SNk generated by the tone generator 5.

(2) The first key release sound signal SF1*k* may be changed for each pitch of keys. Further, the second key release sound signal SF2*k* may be changed for each pitch of keys. For example, the waveform, the tone color, the volume, etc. of the first key release sound signal SF1*k* and the second key release sound signal SF2*k* may be changed for each pitch of keys.

(3) The keyboard 2 may be divided into a plurality of key regions similarly to the keyboard of the acoustic piano. The keyboard of the acoustic piano is divided into a high pitch region that includes a plurality of keys not being provided with dampers, a middle pitch region that includes a plurality of keys being provided with two strings respectively, and a high pitch region that includes a plurality of keys being provided with three strings respectively. In this case, a first key release sound signal SF1*k* may be changed for each key region of the keyboard 2. Further, a second key release sound signal SF2*k* may be changed for each key region of the keyboard 2. For example, the waveform, the tone color, the volume, etc. of the first key release sound signal SF1*k* and the second key release sound signal SF2*k* may be changed for each key region of the keyboard 2.

(4) The tone generator 5 may be configured such that the first key release sound signal SF1*k* and the second key release sound signal SF2*k* change over time. Further, the tone generator 5 may be configured such that the tendencies of the first key release sound signal SF1*k* and the second key release sound signal SF2*k* are different for each electronic musical apparatus 1. In this case, the tone generator 5 may be configured to be capable of adjusting the tendencies of the first key release sound signal SF1*k* and the second key release sound signal SF2*k*. Further, the tone generator 5 may be configured to be capable of selecting, editing or correcting the first key release sound signal SF1*k* and the second key release sound signal SF2*k*. Further, the first key release sound signal SF1*k* and the second key release sound signal SF2*k* may be mixed, and the mixing ratio of the first key release sound signal SF1*k* to the second key release sound signal SF2*k* may be changed according to the moving speed of the key KEk. While the first or second key release sound signal SF1*k*, SF2*k* according to the manner of a key release is generated by the sound signal generation device 100 in the above-mentioned first to third embodiments, the sound signal generation device 100 may be configured to be switchable by a user's operation, for example, between the mode in which the key release sound signal according to the manner of the key release is generated and the mode in which the key release sound signal not according to the manner of the key release is generated.

(5) The present invention is applicable to not only an electronic keyboard musical instrument but also an electronic device such as a smartphone, a tablet terminal or a personal computer. In this case, the keyboard 2 may be connected to the electronic device.

(6) The speed determination period of time T1 may be set to start at any point in time between the point in time t1 and the point in time t21, t22.

[6] Correspondences Between Constituent Elements in Claims and Parts in Preferred Embodiments In the following paragraphs, non-limiting examples of correspondences between various elements recited in the claims below and those described above with respect to various preferred embodiments of the present invention are explained.

In the above-mentioned embodiment, the key depression sound signal generation instructor 104 is an example of a first signal generation instructor, the key release sound signal generation instructor 108 is an example of a second signal generation instructor, the key position determiner 105 is an example of a determiner, and the envelope change instructor 106 is an example of a change instructor. The key depression position is an example of a first position, the key release position is an example of a second position, and the damper release position is an example of a third position. The speed determination period of time T1 is an example of a predetermined period of time, the point in time t1 is an example of a first point in time, the points in time t21, t22 are an example of a second point in time, and the point in time t3 is an example of a third point in time. The key release determination time T3 is an example of a predetermined time, and the point in time t4 is an example of a fourth point in time. As each of constituent elements recited in the claims, various other elements having configurations or functions described in the claims can be also used.

While preferred embodiments of the present invention have been described above, it is to be understood that variations and modifications will be apparent to those skilled in the art without departing the scope and spirit of the present invention. The scope of the present invention, therefore, is to be determined solely by the following claims.

I claim:

1. A sound signal generation device comprising:

a first signal generation instructor configured to provide an instruction for generating a key depression sound signal corresponding to a key depression based on key operation information corresponding to an operation of one or more keys of a keyboard, the generated key depression sound signal being configured to cause generation of an audible key depression sound corresponding to the key depression; and a second signal generation instructor configured to provide an instruction for generating a key release sound signal according to a manner of a key release based on the key operation information, the generated key release sound signal being configured to cause generation of an audible key release sound corresponding to the manner of the key release.

2. The sound signal generation device according to claim 1, further comprising a determiner configured to determine whether a key is in a first key position corresponding to a key depression state or a second key position corresponding to a key release state in a course of the key moving from the key depression state to the key release state based on the key operation information, wherein the manner of the key release includes a moving speed of the key in a predetermined period of time that starts at a point in time between a first point in time at which the key is in the first key position and a second point in time at which the key is in the second key position.

3. The sound signal generation device according to claim 2, wherein the second signal generation instructor is configured to provide the instruction for generating the key release sound signal at different points in time according to the moving speed of the key in the predetermined period of time.

4. The sound signal generation device according to claim 2, wherein the determiner is further configured to determine whether the key is in a third key position between the first key position and the second key position in the course of the key moving from the key depression state to the key release state, the predetermined period of time is a period of time not occurring earlier than a third point in time at which the key is in the third key position, and the second signal generation instructor is configured to provide an instruction for generating a first key release sound signal as the key release sound signal at the second point in time or later than the second point in time in a case where the moving speed of the key in the predetermined period of time is equal to or higher than a threshold value, and to provide an instruction for generating a second key release sound signal as the key release sound signal before the second point in time in a case where the moving speed of the key in the predetermined period of time is lower than the threshold value.

5. The sound signal generation device according to claim 2, wherein the second signal generation instructor is configured to provide an instruction for generating a first key release sound signal as the key release sound signal at the second point in time or later than the second point in time in a case where the key arrives at the second key position by a fourth point in time at which a predetermined time elapses from the first point in time, and to provide an instruction for generating a second key release sound signal as the key release sound signal before the second point in time in a case where the key does not arrive at the second key position by the fourth point in time.

6. The sound signal generation device according to claim 2, wherein the determiner is configured to continuously determine a position of the key in the course of the key moving from the key depression state to the key release state, the predetermined period of time is a period of time not occurring earlier than a third point in time at which the key is in a third key position between the first key position and the second key position, and the second signal generation instructor is configured to provide an instruction for generating a first key release sound signal as the key release sound signal at the second point in time or later than the second point in time in a case where the moving speed of the key in the predetermined period of time is equal to or higher than a threshold value, and to provide an instruction for generating a second key release sound signal as the key release sound signal before the second point in time in a case where the moving speed of the key in the predetermined period of time is lower than the threshold value.

7. The sound signal generation device according to claim 4, wherein the first point in time is a point in time at which a key is in a depression state in an acoustic piano, the second point in time is a point in time at which the key is in a release state in the acoustic piano, and the third point in time is a point in time at which a string corresponding to the key starts to come into contact with a damper in a course of moving of the key from the key depression state to the key release state in the acoustic piano.

8. The sound signal generation device according to claim 2, further comprising a change instructor configured to provide an instruction for changing an attenuation rate of a volume of the key depression sound signal to a first value at a point in time corresponding to a point in time at which a string starts to come into contact with a damper in a course of moving of a key from a depression state to a release state in an acoustic piano and for changing the attenuation rate of the volume of the key depression sound signal to a second value that is larger than the first value at the second point in time, based on the key operation information.

9. A sound signal generation method including:

providing an instruction for generating a key depression sound signal corresponding to a key depression based on key operation information corresponding to an operation of one or more keys of a keyboard, the generated key depression sound signal being configured to cause generation of an audible key depression sound corresponding to the key depression; and providing an instruction for generating a key release sound signal according to a manner of a key release based on the key operation information, the generated key release sound signal being configured to cause generation of an audible key release sound corresponding to the manner of the key release.

10. The sound signal generation method according to claim 9, further including determining whether a key is in a first key position corresponding to a key depression state or a second key position corresponding to a key release state in a course of the key moving from the key depression state to the key release state based on the key operation information, wherein the manner of the key release includes a moving speed of the key in a predetermined period of time that starts at a point in time between a first point in time at which the key is in the first key position and a second point in time at which the key is in the second key position.

11. The sound signal generation method according to claim 10, wherein providing the instruction for generating the key release sound signal includes providing an instruction for generating the key release sound signal at different points in time according to the moving speed of the key in the predetermined period of time.

12. The sound signal generation method according to claim 10, further including determining whether the key is in a third key position between the first key position and the second key position in the course of the key moving from the key depression state to the key release state, wherein the predetermined period of time is a period of time not occurring earlier than a third point in time at which the key is in the third key position, and wherein providing the instruction for generating the key release sound signal includes providing an instruction for generating a first key release sound signal as the key release sound signal at the second point in time or later than the second point in time in a case where the moving speed of the key in the predetermined period of time is equal to or higher than a threshold value, and providing an instruction for generating a second key release sound signal as the key release sound signal before the second point in time in a case where the moving speed of the key in the predetermined period of time is lower than the threshold value.

13. The sound signal generation method according to claim 10, wherein providing the instruction for generating the key release sound signal includes providing an instruction for generating a first key release sound signal as the key release sound signal at the second point in time or later than the second point in time in a case where the key arrives at the second key position by a fourth point in time at which a predetermined time elapses from the first point in time, and providing an instruction for generating a second key release sound signal as the key release sound signal before the second point in time in a case where the key does not arrive at the second key position by the fourth point in time.

14. The sound signal generation method according to claim 10, further including continuously determining a position of the key in the course of the key moving from the key depression state to the key release state, wherein the predetermined period of time is a period of time not occurring earlier than a third point in time at which the key is in a third key position between the first key position and the second key position, and wherein providing the instruction for generating the key release sound signal includes providing an instruction for generating a first key release sound signal as the key release sound signal at the second point in time or later than the second point in time in a case where the moving speed of the key in the predetermined period of time is equal to or higher than a threshold value, and providing an instruction for generating a second key release sound signal as the key release sound signal before the second point in time in a case where the moving speed of the key in the predetermined period of time is lower than the threshold value.

15. The sound signal generation method according to claim 12, wherein the first point in time is a point in time at which a key is in a depression state in an acoustic piano, the second point in time is a point in time at which the key is in a release state in the acoustic piano, and the third point in time is a point in time at which a string corresponding to the key starts to come into contact with a damper in a course of moving of the key from the key depression state to the key release state in the acoustic piano.

16. The sound signal generation method according to claim 10, further including providing an instruction for changing an attenuation rate of a volume of the key depression sound signal to a first value at a point in time corresponding to a point in time at which a string starts to come into contact with a damper in a course of moving of a key from a depression state to a release state in an acoustic piano and changing the attenuation rate of the volume of the key depression sound signal to a second value that is larger than the first value at the second point in time, based on the key operation information.

17. A non-transitory computer readable medium storing a sound signal generation program, the sound signal generation program, when executed by a computer, causing the computer to:

provide an instruction for generating a key depression sound signal corresponding to a key depression based on key operation information corresponding to an operation of one or more keys of a keyboard, the generated key depression sound signal being configured to cause generation of an audible key depression sound corresponding to the key depression; and provide an instruction for generating a key release sound signal according to a manner of a key release based on the key operation information, the generated key release sound signal being configured to cause generation of an audible key release sound corresponding to the manner of the key release.

18. A sound signal generation device comprising:

a first signal generation instructor configured to provide an instruction for generating a key depression sound signal corresponding to a key depression based on key operation information corresponding to an operation of one or more keys of a keyboard, the generated key depression sound signal being configured to cause generation of an audible key depression sound corresponding to the key depression; and a second signal generation instructor configured to provide an instruction for generating a key release sound signal according to a manner of a key release based on the key operation information, the generated key release sound signal being configured to cause generation of an audible key release sound that changes depending on a speed of the key release.

* * * * *